US011171421B2

(12) United States Patent
Yamada et al.

(10) Patent No.: US 11,171,421 B2
(45) Date of Patent: Nov. 9, 2021

(54) ANTENNA MODULE AND COMMUNICATION DEVICE EQUIPPED WITH THE SAME

(71) Applicant: Murata Manufacturing Co., Ltd., Kyoto (JP)

(72) Inventors: Yoshiki Yamada, Kyoto (JP); Keisei Takayama, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 17/150,308

(22) Filed: Jan. 15, 2021

(65) Prior Publication Data

US 2021/0135364 A1 May 6, 2021

Related U.S. Application Data

(63) Continuation of application No. PCT/JP2020/019609, filed on May 18, 2020.

(30) Foreign Application Priority Data

Jun. 28, 2019 (JP) ..... JP2019-120911

(51) Int. Cl.
*H01Q 1/38* (2006.01)
*H01Q 9/04* (2006.01)
(Continued)

(52) U.S. Cl.
CPC ..... *H01Q 9/0414* (2013.01); *H01Q 1/243* (2013.01); *H01Q 5/35* (2015.01); *H01Q 9/045* (2013.01)

(58) Field of Classification Search
CPC ..... H01Q 9/0414; H01Q 5/35; H01Q 9/045; H01Q 1/243
See application file for complete search history.

(56) References Cited

U.S. PATENT DOCUMENTS 6,091,365 A 7/2000 Derneryd et al.
2016/0261047 A1 9/2016 Wallace et al.
(Continued)

FOREIGN PATENT DOCUMENTS

CN 1248348 A 3/2000
EP 3065219 A1 9/2016
(Continued)

OTHER PUBLICATIONS

International Search Report for International Application No. PCT/JP2020/019609 dated Aug. 4, 2020.
(Continued)

*Primary Examiner* — Dieu Hien T Duong
(74) *Attorney, Agent, or Firm* — Pearne & Gordon LLP

(57) ABSTRACT

An antenna module includes a first power feed element and a second power feed element each having a flat plate shape, and a ground electrode (GND) arranged so as to face the first power feed element and the second power feed element. The first power feed element is configured to radiate a radio wave having a first direction as a polarization direction. The second power feed element is arranged between the first power feed element and the ground electrode (GND), and is configured to radiate a radio wave having a second direction as a polarization direction. A frequency of the radio wave radiated from the first power feed element is higher than a frequency of the radio wave radiated from the second power feed element. An angle formed by the first direction and the second direction is greater than 0° and less than 90°.

13 Claims, 10 Drawing Sheets

(51) Int. Cl.
*H01Q 5/35* (2015.01)
*H01Q 1/24* (2006.01)

(56) References Cited

U.S. PATENT DOCUMENTS

2019/0103653 A1* 4/2019 Jeong ..... H01L 25/0655
2020/0358203 A1* 11/2020 Park ..... H01Q 9/0414

FOREIGN PATENT DOCUMENTS

JP 2002-026634 A 1/2002
JP 2007-104257 A 4/2007
JP 2008-061030 A 3/2008
JP 2015-056810 A 3/2015
JP 2019-004241 A 1/2019

OTHER PUBLICATIONS

Written Opinion for International Application No. PCT/JP2020/019609 dated Aug. 4, 2020.

* cited by examiner

ANTENNA MODULE AND COMMUNICATION DEVICE EQUIPPED WITH THE SAME

CROSS REFERENCE TO RELATED APPLICATIONS

This is a continuation of International Application No. PCT/JP2020/019609 filed on May 18, 2020 which claims priority from Japanese Patent Application No. 2019-120911 filed on Jun. 28, 2019. The contents of these applications are incorporated herein by reference in their entireties.

BACKGROUND

Technical Field

The present disclosure relates to an antenna module and a communication device equipped with the antenna module, and more particularly, to an arrangement of a radiating element in an antenna module having a flat plate-shaped radiating element.

Japanese Unexamined Patent Application Publication No. 2007-104257 (Patent Document 1) discloses an antenna module in which two flat-plate electrodes (patch antennas) are arranged in one dielectric block and radio waves in two different frequency bands can be radiated.

The antenna module disclosed in Japanese Unexamined Patent Application Publication No. 2007-104257 (Patent Document 1) has a configuration of a stacked antenna in which two electrodes (first electrode, second electrode) are stacked with respect to a ground electrode in an order of the first electrode, the second electrode, and the ground electrode. In such a configuration, the second electrode arranged between the first electrode and the ground electrode functions as a virtual ground electrode with respect to the first electrode. That is, the first electrode operates as an antenna by electromagnetic field coupling between the first electrode and the second electrode.

Patent Document 1: Japanese Unexamined Patent Application Publication No. 2007-104257

BRIEF SUMMARY

In an ideal patch antenna, it is assumed that a ground electrode has an infinite size with respect to a radiating element. However, in practice, since the ground electrode is not sufficiently large due to the constraint of a substrate size, antenna characteristics may be deteriorated in general as compared with an ideal case.

In the configuration of the stacked antenna module as described in Japanese Unexamined Patent Application Publication No. 2007-104257 (Patent Document 1), the size of the first electrode is smaller than the size of the second electrode, the radio wave on a high-frequency side is emitted from the first electrode, and the radio wave on a low-frequency side is radiated from the second electrode. Here, the size of the electrode is basically determined by the frequency of the radiated radio wave. Therefore, depending on the difference between two frequencies, the size of the second electrode may not be sufficiently large with respect to the first electrode. Then, there is a possibility that sufficient antenna characteristics cannot be exhibited for the antenna formed by the first electrode.

The present disclosure suppresses a decrease in antenna characteristics in a stacked antenna module capable of radiating radio waves in two different frequency bands.

An antenna module according to the present disclosure includes a first power feed element and a second power feed element each having a flat plate shape, and a first ground electrode arranged so as to face the first power feed element and the second power feed element. The first power feed element is configured to be capable of radiating a radio wave having a first direction as a polarization direction. The second power feed element is arranged between the first power feed element and the first ground electrode, and is configured to be capable of radiating a radio wave having a second direction as a polarization direction. When viewed in a plan view from a normal direction of the first power feed element, the first power feed element and the second power feed element overlap each other. A frequency of the radio wave radiated from the first power feed element is higher than a frequency of the radio wave radiated from the second power feed element. A first angle formed by the first direction and the second direction is greater than 0° and less than 90°.

According to the antenna module according to the present disclosure, in the stacked antenna module, two radiating elements are arranged in a manner such that an angle $\sigma$ formed by a polarization direction (first direction) of a radio wave radiated from a radiating element (first power feed element) on a high-frequency side and a polarization direction (second direction) of a radio wave radiated from a radiating element on a low-frequency side (second power feed element) is $0° < \theta < 90°$. With such a configuration, a distance from an end portion of the first power feed element along the polarization direction (first direction) of the first power feed element to an end portion of the second power feed element when the antenna module is viewed in a plan view of the antenna module can be made long as compared with a case where the polarization direction of the first power feed element coincides with or orthogonal to the polarization direction of the second power feed element. Therefore, it is possible to suppress a decrease in the antenna characteristics.

DETAILED DESCRIPTION

Figure 1:
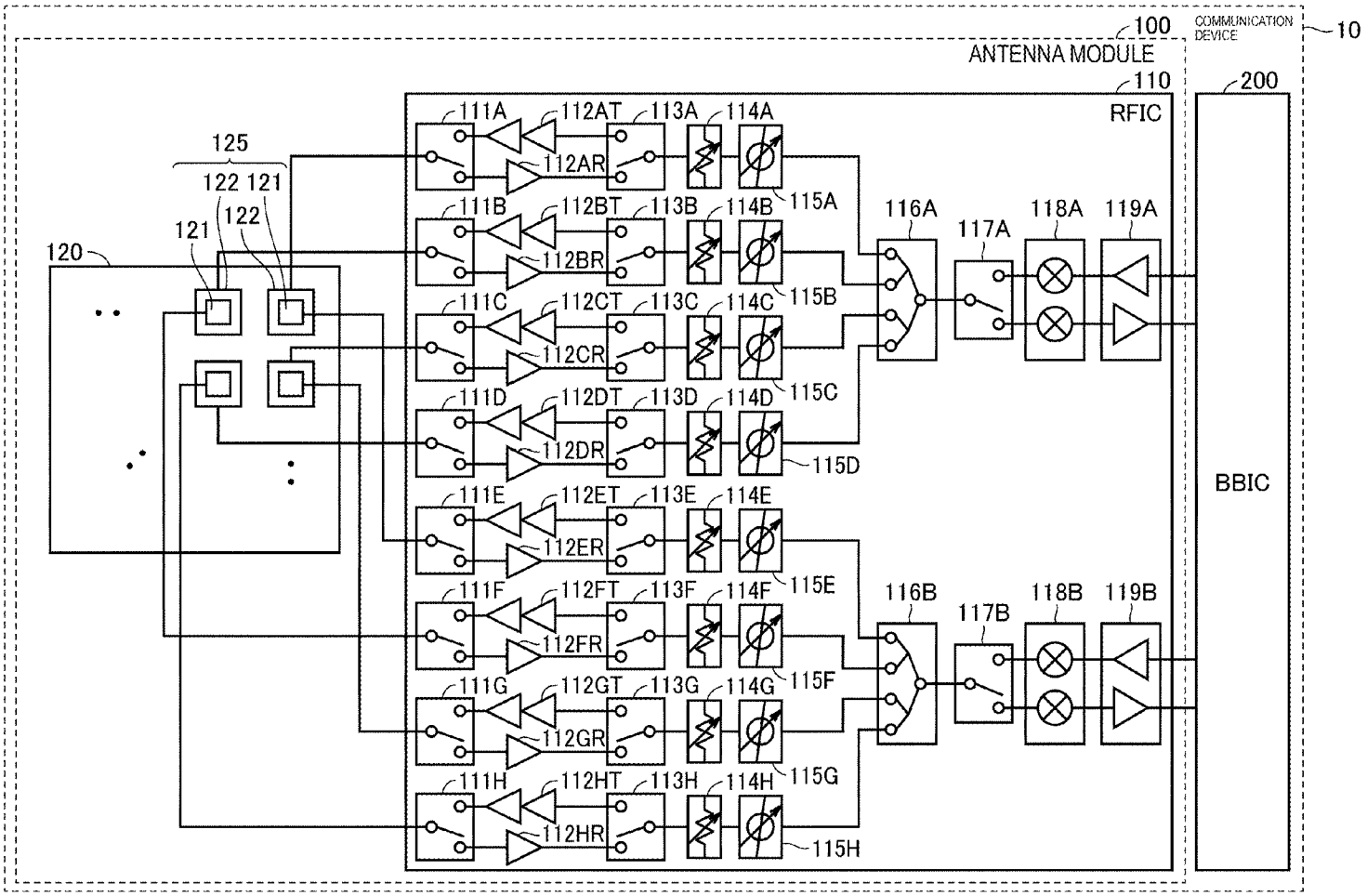
FIG. 1 is a block diagram of a communication device to which an antenna module according to Embodiment 1 is applied.

Hereinafter, embodiments of the present disclosure will be described in detail with reference to the accompanying drawings. Note that the same or corresponding parts in the drawings are denoted by the same reference numerals, and the description thereof will not be repeated.

[Embodiment 1]

(Basic Configuration of Communication Device)

FIG. 1 is a block diagram of an example of a communication device 10 to which an antenna module 100 according to Embodiment 1 is applied. The communication device 10 is, for example, a mobile terminal, such as a mobile phone, a smartphone, or a tablet, a personal computer having a communication function, or the like.

Referring to FIG. 1, the communication device 10 includes the antenna module 100 and a BBIC 200 which configures a baseband signal processing circuit. The antenna module 100 includes an RFIC 110, which is an example of a power feed circuit, and an antenna device 120. The communication device 10 upconverts a signal transmitted from the BBIC 200 to the antenna module 100 into a radio frequency signal to radiate the signal from the antenna device 120, and downconverts the radio frequency signal received by the antenna device 120 to process the signal in the BBIC 200.

In the antenna device 120 illustrated in FIG. 1, radiating elements 125 are arranged in a two-dimensional array. Each of the radiating elements 125 includes two power feed elements 121 and 122. As will be described later in FIG. 2, the power feed elements 121 and 122 are arranged so as to overlap with each other in a normal direction of the power feed element. The antenna device 120 is configured to be capable of radiating radio waves in different frequency bands from the power feed element 121 and the power feed element 122 of the radiating element 125, respectively. That is, the antenna device 120 is a stacked dual-band antenna device. Different radio frequency signals are supplied from the RFIC 110 to each of the power feed elements 121 and 122.

In FIG. 1, for ease of description, only configurations corresponding to four radiating elements 125 among a plurality of radiating elements 125 included in the antenna device 120 are illustrated, and configurations corresponding to other radiating elements 125 having the same configuration are omitted. Note that the antenna device 120 does not necessarily have to be a two-dimensional array, and the antenna device 120 may be formed by one radiating element 125. In addition, a one-dimensional array may be provided in which the plurality of radiating elements 125 are arranged in a row. In the present embodiment, the power feed elements 121 and 122 included in the radiating element 125 are a patch antenna having a flat plate shape.

The RFIC 110 includes switches 111A to 111H, 113A to 113H, 117A, and 117B, power amplifiers 112AT to 112HT, low noise amplifiers 112AR to 112HR, attenuators 114A to 114H, phase shifters 115A to 115H, signal multiplexers/demultiplexers 116A and 116B, mixers 118A and 118B, and amplifier circuits 119A and 119B. Among these, configurations of the switches 111A to 111D, 113A to 113D, and 117A, the power amplifiers 112AT to 112DT, the low noise amplifiers 112AR to 112DR, the attenuators 114A to 114D, the phase shifters 115A to 115D, the signal multiplexer/demultiplexer 116A, the mixer 118A, and the amplifier circuit 119A are circuits for the radio frequency signals in a first frequency band radiated from the power feed element 121. Further, configurations of the switches 111E to 111H, 113E to 113H, and 117B, the power amplifier 112ET to 112HT, the low noise amplifiers 112ER to 112HR, the attenuators 114E to 114H, the phase shifters 115E to 115H, the signal multiplexer/demultiplexer 116B, the mixer 118B, and the amplifier circuit 119B are circuits for the radio frequency signals in a second frequency band radiated from the power feed element 122.

In a case where the radio frequency signals are transmitted, the switches 111A to 111H and 113A to 113H are switched to the power amplifiers 112AT to 112HT side, and the switches 117A and 117B are connected to amplifiers on a transmission side of the amplifier circuits 119A and 119B, respectively. In a case where the radio frequency signals are received, the switches 111A to 111H and 113A to 113H are switched to the low noise amplifiers 112AR to 112HR side, and the switches 117A and 117B are connected to amplifiers on a reception side of the amplifier circuits 119A and 119B, respectively.

The signals transmitted from the BBIC 200 are amplified by the amplifier circuits 119A and 119B, and are upconverted in the mixers 118A and 118B. The transmission signals, which are upconverted radio frequency signals, are demultiplexed into four signals in the signal multiplexers/demultiplexers 116A and 116B, and are fed to the different power feed elements 121 and 122, respectively, after passing through corresponding signal paths. The directivity of the antenna device 120 can be adjusted by individually adjusting the degrees of phase shift of the phase shifters 115A to 115H arranged in the respective signal paths.

The reception signals, which are the radio frequency signals received by each of the power feed elements 121 and 122, are transmitted to the RFIC 110, and are multiplexed in the signal multiplexers/demultiplexers 116A and 116B via four signal paths which are different from each other. The multiplexed reception signals are downconverted in the mixers 118A and 118B, amplified by the amplifier circuits 119A and 119B, and transmitted to the BBIC 200.

The RFIC 110 is formed as, for example, a one-chip integrated circuit component including the above-described circuit configuration. Alternatively, the devices (switches, power amplifiers, low noise amplifiers, attenuators, and phase shifters) corresponding to the respective radiating elements 125 in the RFIC 110 may be formed as one-chip integrated circuit component for each corresponding radiating element 125.

(Configuration of Antenna Module)

Figure 2:
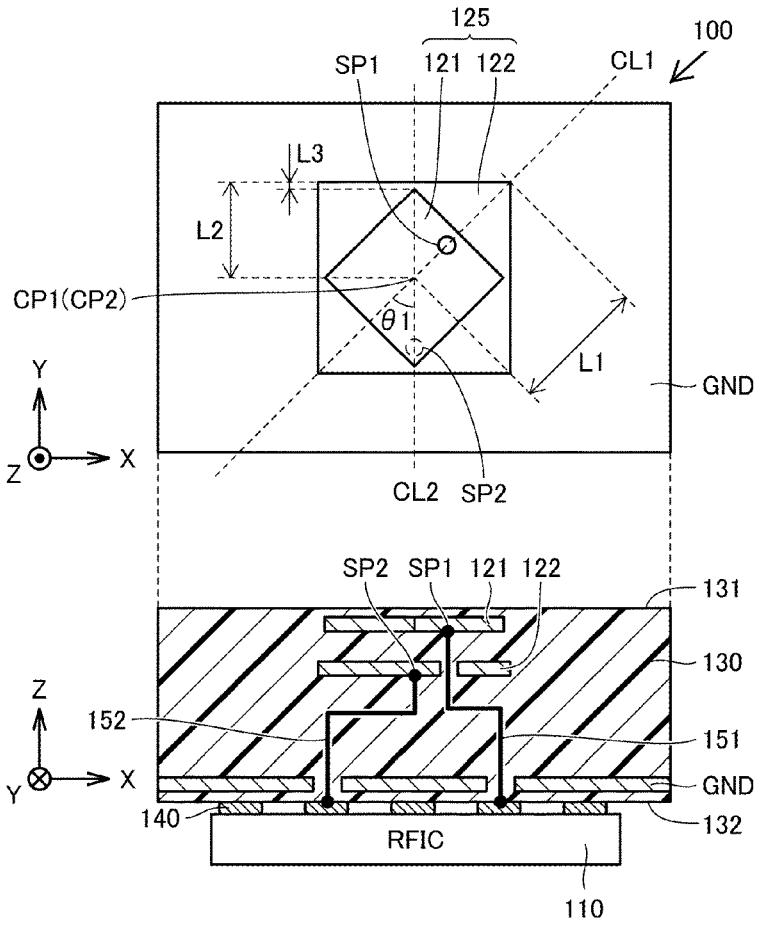
FIG. 2 is a diagram illustrating the antenna module according to Embodiment 1.

Next, a configuration of the antenna module 100 according to Embodiment 1 will be described in detail with reference to FIG. 2. In FIG. 2, a plan perspective view of the antenna module 100 is illustrated in an upper stage, and a cross-sectional perspective view of the antenna module 100 is illustrated in a lower stage. In the following description, for ease of description, an antenna module in which one radiating element 125 is formed will be described as an example. Note that, as illustrated in FIG. 2, a thickness direction of the antenna module 100 is defined as a Z-axis direction, and a plane perpendicular to the Z-axis direction is defined as an X-axis and a Y-axis. In addition, a positive direction of the Z-axis in each figure may be referred to as an upper surface side, and a negative direction may be referred to as a lower surface side in some cases.

Referring to FIG. 2, the antenna module 100 includes a dielectric substrate 130, a ground electrode GND, and power feed wirings 151 and 152 in addition to the RFIC 110 and the radiating element 125 (power feed elements 121 and 122). Note that, in the plan perspective view, the RFIC 110, the dielectric substrate 130, and the power feed wirings 151 and 152 are omitted. In the antenna module 100 of FIG. 2, the "power feed element 121" and the "power feed element 122" correspond to the "first power feed element" and the "second power feed element" of the present disclosure, respectively.

The dielectric substrate 130 is, for example, a low temperature co-fired ceramics (LTCC) multilayer substrate, a multilayer resin substrate formed by laminating a plurality of resin layers made of resin, such as epoxy, polyimide, or the like, a multilayer resin substrate formed by laminating a plurality of resin layers made of a liquid crystal polymer (LCP) having lower dielectric constant, a multilayer resin substrate formed by laminating a plurality of resin layers made of fluorine resin, or a ceramics multilayer substrate other than LTCC. Note that the dielectric substrate 130 does not necessarily have a multilayer structure, and may be a single-layer substrate.

The dielectric substrate 130 has a substantially rectangular shape when viewed in a plan view from a normal direction (Z-axis direction). A rectangular ground electrode GND is arranged on the side of a lower surface 132 (a surface in the negative direction of the Z-axis) side of the dielectric substrate 130, and the power feed element 121 is arranged so as to face the ground electrode GND on the side of an upper surface 131 (a surface in the positive direction of the Z-axis). The power feed element 121 may be exposed to the surface of the dielectric substrate 130, or may be arranged in an inner layer of the dielectric substrate 130 as illustrated in the example of FIG. 2.

The power feed element 122 is arranged so as to face the ground electrode GND in a layer closer to the ground electrode GND than the power feed element 121. In other words, the power feed element 122 is arranged in a layer between the power feed element 121 and the ground electrode GND. The power feed element 121 overlaps the power feed element 121 when the dielectric substrate 130 is viewed in a plan view from the normal direction of the power feed element 122. The size of the power feed element 121 is smaller than the size of the power feed element 122, and a resonant frequency of the power feed element 121 is higher than a resonant frequency of the power feed element 122. That is, the frequency of the radio wave radiated from the power feed element 121 is higher than the frequency of the radio wave radiated from the power feed element 122. For example, the frequency of the radio wave radiated from the power feed element 121 is 39 GHz, and the frequency of the radio wave radiated from the power feed element 122 is 28 GHz.

Note that in the antenna module 100 illustrated in FIG. 2, the configuration is illustrated in which the power feed elements 121 and 122 are arranged in the continuous dielectric substrate 130, but a configuration may be adopted in which one or both of the power feed elements 121 and 122 are arranged in different dielectrics which are separated from each other. For example, a configuration may be adopted in which the RFIC 110 and the ground electrode GND are mounted on a mounting substrate inside the communication apparatus, and a portion of the radiating element is arranged in a housing of the communication device.

In addition, in the antenna module 100, the configuration is described in which the power feed elements 121 and 122 are supplied with power by being directly connected to the power feed wirings 151 and 152, but, a configuration may be adopted in which one or both of the power feed elements 121 and 122 are supplied with power by capacitive coupling with the power feed wiring 151 or the power feed wiring 152.

The RFIC 110 is mounted on the lower surface 132 of the dielectric substrate 130 with a solder bump 140 interposed therebetween. Note that, instead of the solder connection, the RFIC 110 may be connected to the dielectric substrate 130 by using a multipolar connector.

A radio frequency signal is transmitted to the power feed element 121 from the RFIC 110 via the power feed wiring 151. The power feed wiring 151 passes through the ground electrode GND and the power feed element 122 from the RFIC 110, and is connected to a power feed point SP1 from a lower surface side of the power feed element 121. That is, the power feed wiring 151 transmits a radio frequency signal to the power feed point SP1 of the power feed element 121.

A radio frequency signal is transmitted to the power feed element 122 from the RFIC 110 via the power feed wiring 152. The power feed wiring 152 passes through the ground electrode GND from the RFIC 110 and is connected to a power feed point SP2 from a lower surface side of the power feed element 122. That is, the power feed wiring 152 transmits a radio frequency signal to the power feed point SP2 of the power feed element 122.

The power feed wirings 151 and 152 are formed of a wiring pattern formed between the layers of the dielectric substrate 130 and a via passing through the layers. Note that in the antenna module 100, conductors configuring a radiating element, a wiring pattern, an electrode, a via, and the like are formed of a metal containing aluminum (Al), copper (Cu), gold (Au), silver (Ag), and an alloy thereof as a main component.

In the antenna module 100 according to Embodiment 1, each of the power feed elements 121 and 122 has a substantially square shape. The power feed element 122 is arranged such that each of sides thereof is parallel to each of sides of the ground electrode GND. The power feed point SP2 of the power feed element 122 is arranged at a position offset from a center of the power feed element 122 in a negative direction of the Y-axis.

On the other hand, the power feed element 121 is arranged such that a center CP1 of the power feed element 121 coincides with a center CP2 of the power feed element 122 and the power feed element 121 is rotated by θ1 with respect to the power feed element 122. In other words, the power feed element 121 is arranged such that an angle (a first angle) formed by a direction connecting the center CP1 of the power feed element 121 and the power feed point SP1 (a direction of a line CL1: a first direction) and a direction connecting the center CP2 of the power feed element 122 and the power feed point SP2 (a direction of a line CL2: a second direction) becomes θ1.

An inclination (i. e., the angle θ1) of the power feed element 121 with respect to the power feed element 122 is greater than 0° and less than 90° ($0° < \theta 1 < 90°$). Note that FIG. 2 illustrates a case where $\theta 1 = 45°$ is satisfied in the antenna module 100.

In the antenna module 100 like this, a radio wave having the direction of the line CL1 (the first direction) as a polarization direction is radiated from the power feed element 121, and a radio wave having the direction of the line CL2 (the second direction) as a polarization direction is radiated from the power feed element 122.

At this time, in a case where the antenna module 100 is viewed in a plan view from the normal direction of the power feed element 121, when a shortest distance along the first direction between the center CP1 of the power feed element 121 and an end portion of the power feed element 122 is defined as a distance L1 (first distance), and a shortest distance between the center CP1 of the power feed element 121 and an end portion of the power feed element 122 is defined as a distance L2 (second distance), the distance L1 is longer than the distance L2 (L1>L2). Further, when a shortest distance between an end portion of the power feed element 121 along the direction of the distance L2 and the end portion of the power feed element 122 is defined as a distance L3 (third distance), the distance L3 is shorter than ½ of the size (a length of the side) of the power feed element 121.

As described above, in the antenna module 100 according to Embodiment 1, the power feed element 121 is arranged to be inclined with respect to the power feed element 122, thereby suppressing deterioration of the antenna characteristics of the power feed element 121. Hereinafter, a mechanism by which deterioration of the antenna characteristics can be suppressed due to the arrangement of the power feed element 121 will be described with reference to FIG. 3.

Figure 3B:
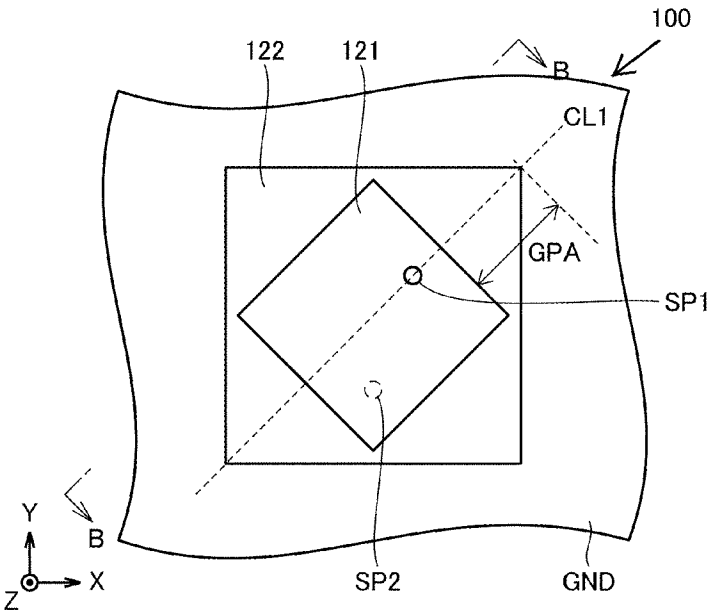
FIGS. 3A and 3B are diagrams for schematically explaining a mechanism in which antenna characteristics are improved in Embodiment 1.
Figure 3B:
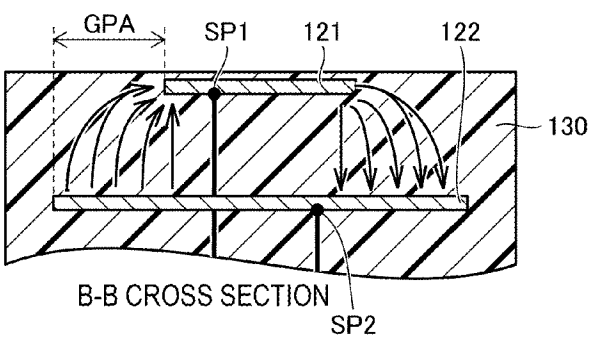
Figure 3A:
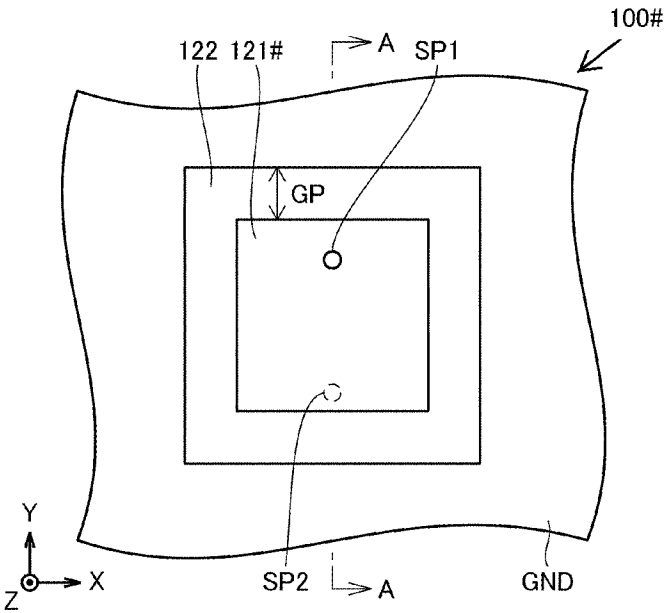
Figure 3A:
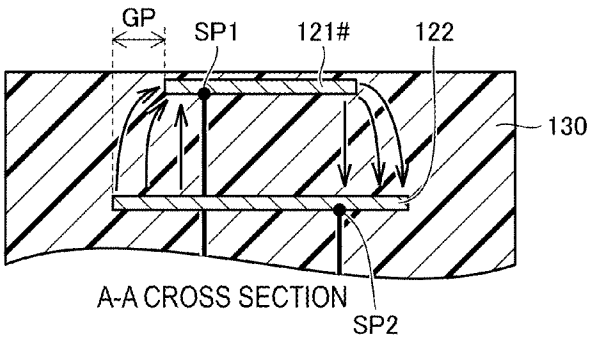

In FIGS. 3A and B, a left diagram (FIG. 3A) illustrates an antenna module 100# according to a comparative example, and a right diagram (FIG. 3B) illustrates the antenna module 100 according to Embodiment 1. In each of FIG. 3A and FIG. 3B, the upper stage illustrates a plan perspective view of the antenna module, and the lower stage illustrates electric flux lines between the power feed elements in a cross-section (a cross-section taken along a line A-A, a cross-section taken along a line B-B) along the polarization direction of the power feed element.

In the antenna module 100#, a side of a power feed element 121# and the side of the power feed element 122 are arranged so as to be parallel to each other. Then, the power feed point SP1 of the power feed element 121# is arranged to be offset in a positive direction of the Y-axis, and a radio wave having the Y-axis direction as a polarization direction is radiated from the power feed element 121# in the same manner as the power feed element 122.

The power feed element 122 functions as a virtual ground electrode of the power feed element 121#, and the power feed element 121# operates as an antenna due to the electromagnetic field coupling between the power feed element 121# and the power feed element 122.

At this time, in the power feed element 121#, an amplitude of the voltage becomes maximum at an end portion in the Y-axis direction, and an intensity of electric field between the power feed element 121# and the power feed element 122 is also maximized at the end portion. However, when the power feed element 121# is viewed in a plan view, since a distance GP between an end portion of the power feed element 121# in the polarization direction (Y-axis direction) and the end portion of the power feed element 122 is short, an amount of the electric flux lines generated between the power feed element 121# and the power feed element 122 is limited, and the coupling between the power feed element 121# and the power feed element 122 cannot be sufficiently secured. Accordingly, an electrostatic capacity of the power feed element 121# with respect to the power feed element 122 may not be sufficiently secured, and a frequency band width may become narrow.

On the other hand, in the antenna module 100 of Embodiment 1 of FIG. 3B, by arranging the power feed element 121 to be inclined with respect to the power feed element 122, a distance GPA between the end portion of the power feed element 121 along the polarization direction (the direction of the line CL1: the first direction) and the end portion of the power feed element 122 is longer than the distance GP in the case of the comparative example. As a result, the coupling due to the electric field between the power feed element 121 and the power feed element 122 becomes stronger than in the case of the comparative example. Therefore, the electrostatic capacity of the power feed element 121 with respect to the power feed element 122 becomes larger than that in the comparative example, and the frequency band width can be expanded as compared with the case of the comparative example.

Thus, in Embodiment 1, in the stacked dual-band type antenna module, in a case where the shortest distance between the power feed element 121 and the power feed element 122 when the antenna module is viewed in a plan view is shorter than a predetermined distance, it is possible to expand the frequency band width by arranging the power feed element 121 in a manner such that the polarization direction thereof is inclined with respect to the polarization direction of the power feed element 122 as described above. Whereby, it is possible to suppress a decrease in the antenna characteristics of the power feed element 121 on the high-frequency side.

Note that, in a case where the angle formed by the polarization direction of the power feed element 122 and the polarization direction of the power feed element 121 (i. e., the inclination θ1 of the power feed element 121 with respect to the power feed element 122) is 45°, the power feed element 121 can be arranged in line symmetry to the power feed element 122, and thus, circularly polarized waves of the radiated radio waves can be suppressed. Therefore, it is possible to improve isolation between linearly polarized waves of two radiating elements.

[Embodiment 2]

In Embodiment 2, a configuration in which the antenna modules illustrated in FIG. 2 of Embodiment 1 are arranged in a one-dimensional array will be described.

Figure 4:
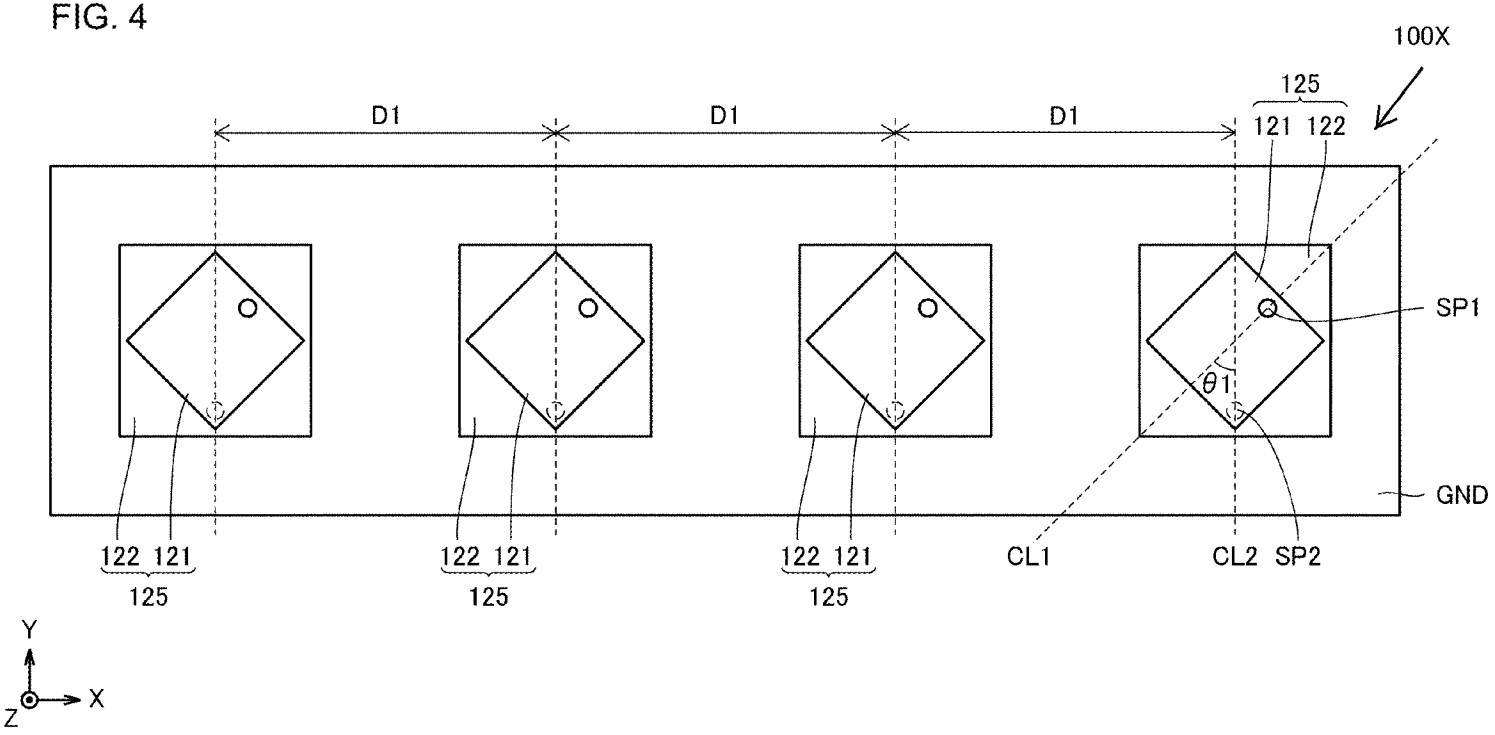
FIG. 4 is a diagram for explaining an antenna module according to Embodiment 2.

FIG. 4 is a diagram for explaining an antenna module 100X according to Embodiment 2. Referring to FIG. 4, the antenna module 100X has a configuration in which four radiating elements 125 (power feed element 121+power feed element 122) in FIG. 2 are arrayed along the X-axis direction. The radiating elements 125 adjacent to each other are arranged with an interval D1 therebetween. In the antenna module 100X, the interval D1 can be set to be wider than ½ of the wave length of the radio wave on the low-frequency side (28 GHz).

Generally, in the case of an array antenna, the interval between adjacent radiating elements is set to ½ of the wave length of the radio wave radiated from the radiating element. However, as in the antenna module 100X of FIG. 4, by making the interval between adjacent elements wider than in the general case, it is possible to increase the isolation between the adjacent elements. This makes it possible to suppress deterioration in active impedance in the antenna module, and as a result, it is possible to widen an antenna gain.

[Embodiment 3]

In Embodiment 1, the configuration is described in which the power feed element 121 is arranged to be inclined with respect to the power feed element 122 in a case where the distance in the polarization direction between the power feed element 121 and the power feed element 122 functioning as the virtual ground electrode of the power feed element 121 cannot be sufficiently secured.

In Embodiment 3, a configuration will be described in which the power feed element 122 is arranged to be inclined with respect to the ground electrode GND in a case where the distance in the polarization direction between the power feed element 122 and the ground electrode GND cannot be sufficiently secured.

Figure 5A:
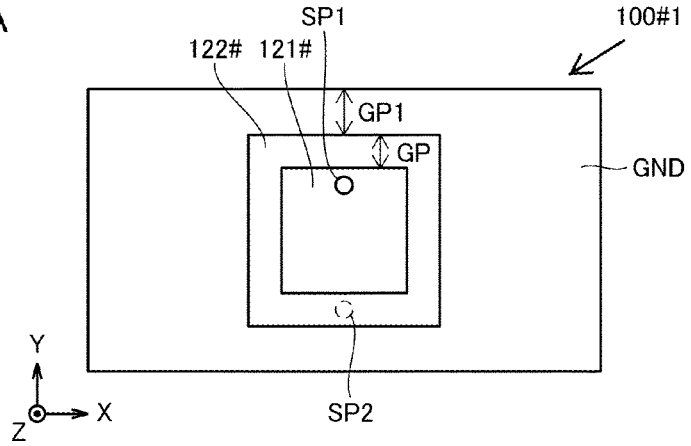
FIGS. 5A and 5B are diagrams for describing an antenna module according to Embodiment 3.
Figure 5B:
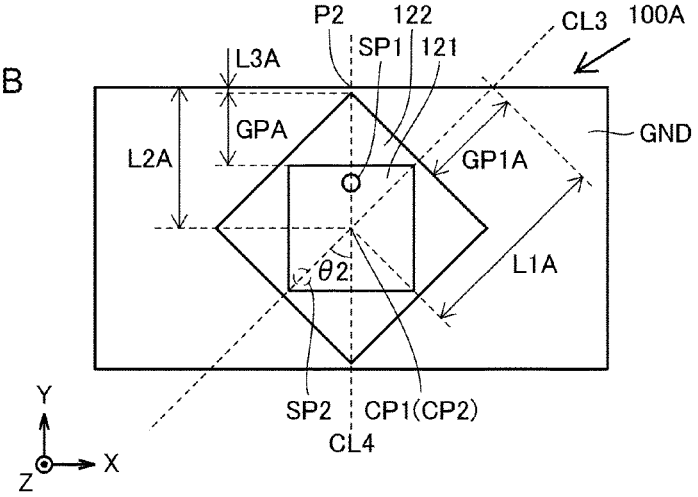

FIGS. 5A and 5B are diagrams for explaining an antenna module 100A according to Embodiment 3. FIGS. 5A and 5B indicate a plan perspective view of an antenna module 100#1 of the comparative example in the upper stage (FIG. 5A), and a plan perspective view of the antenna module 100A of Embodiment 3 in the lower stage (FIG. 5B).

In the antenna module 100#1 of the comparative example, the power feed element 121# and the power feed element 122# are arranged such that each of sides is parallel to the ground electrode GND having a rectangular shape. The ground electrode GND has a dimension limited in a polarization direction (i. e., the Y-axis direction) of the power feed element 122#, and the distance GP1 between the power feed element 122# and the ground electrode GND in the polarization direction cannot be sufficiently secured. Also, as in Embodiment 1, the power feed element 121# is in a state in which the distance GP between the power feed element 121# and the power feed element 122# in a polarization direction of the power feed element 121# cannot be sufficiently secured.

In the antenna module 100A of Embodiment 3, the power feed element 122 is arranged with respect to the ground electrode GND such that an angle θ2 (second angle) formed by a direction (a direction of a line CL4) connecting a position P2 of an end portion of the ground electrode GND having a shortest distance from the center CP2 of the power feed element 122 and the center CP2 of the power feed element 122 and the polarization direction of the power feed element 122 (a direction of a line CL3) is greater than 0° and less than 90°. Note that, FIG. 5B illustrates a case where θ2=45° is satisfied.

In other words, as viewed in a plan view from the normal direction of the power feed element 122, when a shortest distance along the polarization direction between the center of the power feed element 122 and the end portion of the ground electrode GND is defined as a distance L1A (fourth distance), and a shortest distance between the center CP2 of the power feed element 122 and the end portion of the ground electrode GND is defined as a distance L2A (fifth distance), the distance L1A is longer than the distance L2A (L1A>L2A). Further, when a distance between the end portion of the ground electrode GND along the direction of the distance L2A and the end portion of the power feed element 122 is defined as a distance L3A (sixth distance), the distance L3A is shorter than ½ of the size (the length of the side) of the power feed element 122.

With such an arrangement, the distance GP1A between the end portion of the power feed element 122 along the polarization direction of the power feed element 122 and the end portion of the ground electrode GND can be made longer than the distance GP1 in the comparative example. Therefore, by inclining the polarization direction of the power feed element 122 with respect to the ground electrode GND, it is possible to suppress a decrease in the frequency band width of the power feed element 122.

Further, as for the power feed element 121, similarly to Embodiment 1, the power feed element 121 is arranged by inclining the polarization direction of the power feed element 121 with respect to the polarization direction of the power feed element 122 at the angle θ1 of between 0° and 90°. Note that, FIG. 5B illustrates an example of a case where θ1=45°, and θ2=45° in FIG. 5B as described above, so that the polarization direction of the power feed element 121 coincides with the Y-axis direction.

Whereby, the distance GPA between the end portion of the power feed element 121 along the polarization direction of the power feed element 121 and the end portion of the power feed element 122 can be made longer than the distance GP in the case of the comparative example. Therefore, it is possible to suppress a decrease in the frequency band width of the power feed element 121 as well.

[Embodiment 4]

In Embodiment 3, the configuration is described in which the power feed element 122 on the low-frequency side is arranged to be inclined with respect to the ground electrode GND, and the power feed element 121 on the high-frequency side is arranged to be inclined with respect to the power feed element 122 on the low-frequency side.

On the other hand, when miniaturization and high density are achieved in the antenna module, an area of the ground electrode GND is limited, and when the power feed element 122 is inclined, the power feed element 122 may not fit in the range of the ground electrode GND.

In Embodiment 4, a configuration corresponding to a case where the area of the ground electrode GND is limited and the inclined power feed element 122 does not fall within the range of the ground electrode GND will be described.

FIGS. 6A-6D are diagrams for describing an antenna module 100B according to Embodiment 4.

Referring to FIGS. 6A-6D, a case in which the power feed element 121 and the power feed element 122 are arranged in a portion protruding in the Y-axis direction in the ground electrode GND will be considered. At this time, the protruding portion in which the power feed element is arranged has an area slightly larger than that of the power feed element 122.

Figures 6A, 6B, 6C, 6D:
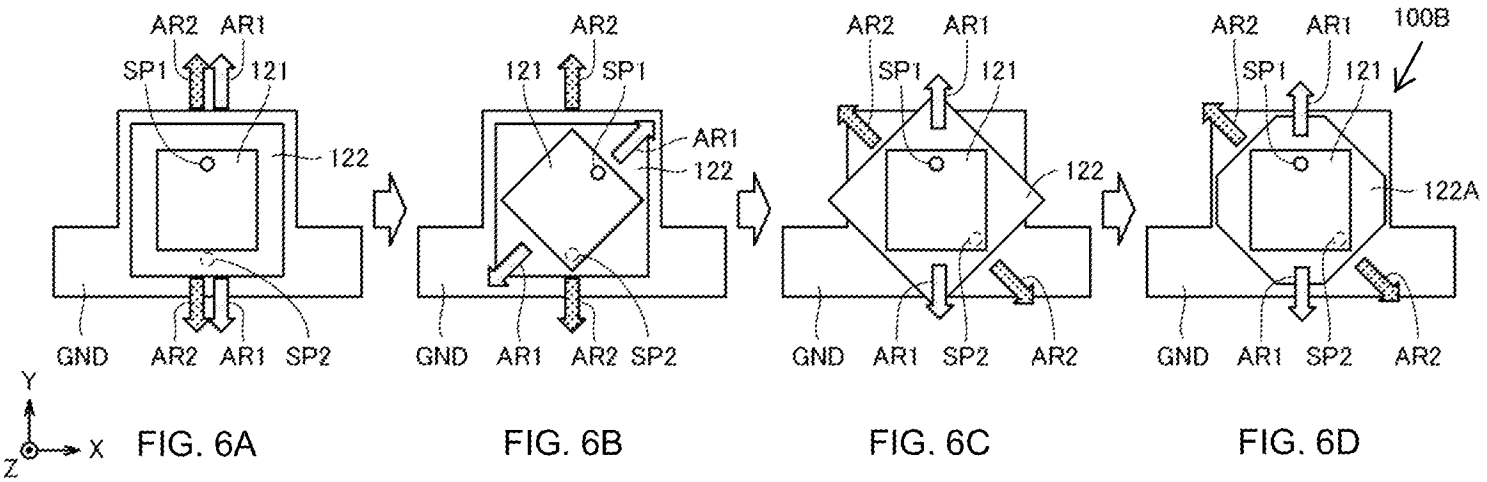
FIGS. 6A, 6B, 6C, and 6D are diagrams for describing an antenna module according to Embodiment 4.

FIG. 6A is a diagram illustrating an initial state, in FIG. 6A, the power feed element 122 is arranged so as to fit in the range of the ground electrode GND, and the power feed element 121 is arranged such that each side thereof is parallel to the power feed element 122. The power feed points SP1 and SP2 of the power feed elements 121 and 122 each are arranged at positions offset from the center of the power feed element in the Y-axis direction, and radio waves having the Y-axis direction as a polarization direction (arrows AR1 and AR2) are radiated from each of the power feed elements. In the case of such an arrangement, a distance between the power feed element 121 and the power feed element 122 in the polarization direction and a distance between the power feed element 122 and the ground electrode GND cannot be sufficiently secured.

FIG. 6B is a diagram illustrating a state in which the power feed element 121 is arranged so as to incline the polarization direction (AR1) of the power feed element 121 with respect to the polarization direction (AR2) of the power feed element 122, as described in Embodiment 1. In the example illustrated in FIG. 6B, the case in which the power feed element 122 is rotated clockwise by 45° with respect to the power feed element 121 is illustrated. With such an arrangement, the distance between the end portion of the power feed element 121 along the polarization direction (AR1) of the power feed element 121 and the end portion of the power feed element 122 can be made long as compared with the case of FIG. 6A.

FIG. 6C is a diagram illustrating a state in which the power feed element 122 is arranged to be inclined with respect to the ground electrode GND in order to secure the distance from the ground electrode GND along the polarization direction (AR2) of the power feed element 122, as described in Embodiment 3. More specifically, FIG. 6C illustrates a case where the power feed elements 121 and 122 are rotated counterclockwise by 45° from the state illustrated in FIG. 6B. With such an arrangement, the distance between the end portion of the power feed element 122 along the polarization direction (AR2) of the power feed element 122 and the end portion of the ground electrode GND can be made long as compared with the case of FIG. 6A.

However, FIG. 6C illustrates a case in which a corner portion of the substantially square power feed element 122 extends beyond the ground electrode GND. As such, in the antenna module 100B illustrated in FIG. 6D, a portion of the power feed element 122 which extends beyond the ground electrode GND is cut off, and the power feed element 122 is formed in an octagonal shape. In this case, the length of the power feed element 121 in the polarization direction (AR1) of the power feed element 122 becomes shorter than those in the cases illustrated in FIGS. 6B and 6C, but the length is longer than that in the initial state in FIG. 6A, so that effect to a certain degree can be provided.

With such the configuration of the antenna module 100B, even in the case where the area of the ground electrode GND is limited, the distance between the power feed elements 121 and 122 in the polarization direction and the distance between the power feed element 122 and the ground electrodes GND can be set to be longer than that in the case of the initial state, so that it is possible to suppress a decrease in the frequency band width of each power feed element.

Note that, in the above example, the case where the power feed element 122 has the octagonal shape is described, however, the shape of the power feed element 122 may have a polygonal shape other than an octagonal shape depending on the shape of the ground electrode GND. That is, the power feed element 122 may have a polygonal shape having equal to or more than four vertices. However, when the symmetry of the shape of the power feed element 122 is broken, the direction of the current flowing through the power feed element 122 is disturbed, and therefore, the polarization of the radio waves radiated from the power feed element 122 and the power feed element 121 may become a circularly polarized wave. In such a case, it is suitable to perform changes in which an auxiliary electrode is partially added to each of the power feed elements, and the like, and to adjust the radio wave to be radiated so as to mainly contain a linearly polarized wave.

In addition, in the antenna module 100B of FIGS. 6A-6D, the case where the power feed element 121 falls within the range of the power feed element 122 even when being arranged to be inclined with respect to the power feed element 122 is described, however, in a case where the power feed element 121 extends, when being inclined, beyond the power feed element 122, the power feed element 121 may be cut off by a portion extending beyond the power feed element 122 as in the case of the power feed element 122 described above. Also, in this case, when a polarization wave of the radio wave radiated from the power feed element 121 is a circularly polarized wave, the radio wave to be radiated is adjusted to mainly contain a linearly polarized wave by addition of the auxiliary electrode, or the like.

(Application Example)

Figure 7:
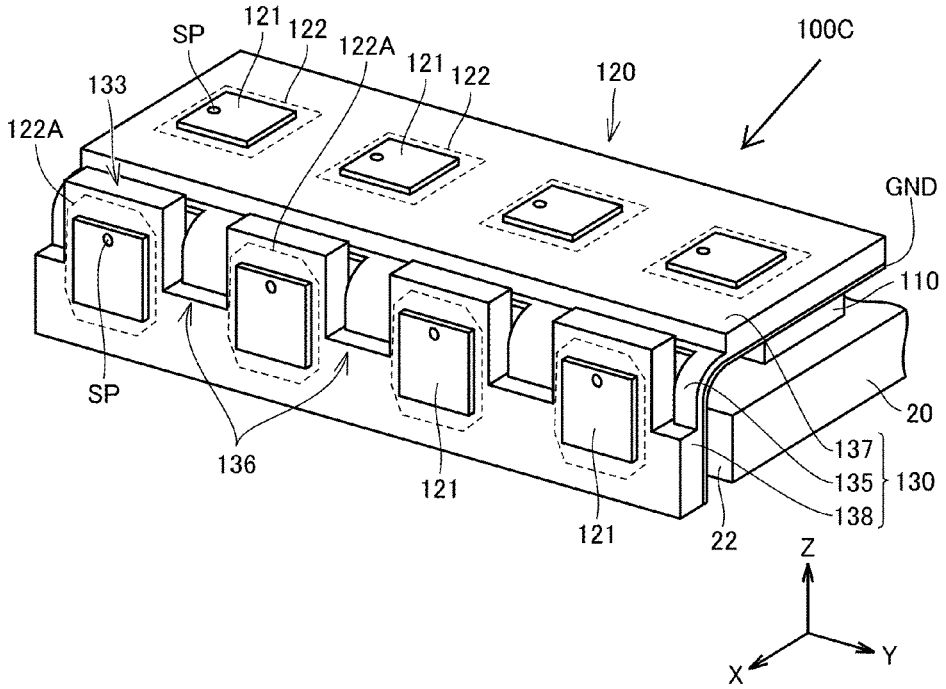
FIG. 7 is a diagram illustrating a first example of the antenna module to which Embodiment 4 is applied.

A configuration example to which Embodiment 4 is applied will be described with reference to FIG. 7. FIG. 7 is a perspective view of an antenna module 100C having two different radiation surfaces.

Referring to FIG. 7, in the antenna device 120 of the antenna module 100C, the dielectric substrate 130 has a substantially L-shaped cross-section, and includes a flat plate-shaped substrate 137 having the Z-axis direction of FIG. 7 as a normal direction, a flat plate-shaped substrate 138 having the X-axis direction as a normal direction, and a bent portion 135 connecting the two substrates 137 and 138 to each other.

In the antenna module 100C, four power feed elements 121 are arranged in a row in the Y-axis direction on each of the two substrates 137 and 138. In the following description, for ease of understanding, an example in which the power feed element 121 is arranged so as to be exposed on surfaces of the substrates 137 and 138 will be described, but as illustrated in FIG. 2 of Embodiment 1, the power feed element 121 may be arranged inside dielectric substrates of the substrates 137 and 138.

The substrate 137 has a substantially rectangular shape, and four power feed elements 121 are arranged in a row on the surface of the substrate 137. In addition, in the substrate 137, the power feed element 122 is arranged in an inner layer of the dielectric substrate so as to face each power feed element 121. The RFIC 110 is connected to a lower surface side (a surface in the negative direction of the Z-axis) of the substrate 137. The RFIC 110 is mounted on a mounting substrate 20 by a solder bump or a multipolar connector.

The substrate 138 is connected to the bent portion 135 bent from the substrate 137, and is arranged such that an inner side surface of the substrate 138 (a surface in the negative direction of the X-axis) faces a side surface 22 of the mounting substrate 20. The substrate 138 has a configuration in which a plurality of notch portions 136 is formed in the substantially rectangular dielectric substrate, and the bent portions 135 are connected to the notch portions 136. In other words, on a portion of the substrate 138 where the notch portion 136 is not formed, a protruding portion 133 protruding in a direction toward the substrate 137 along the substrate 138 (i. e., the positive direction of the Z-axis direction) from a boundary portion where the bent portion 135 and the substrate 138 are connected is formed. A protruding end portion of the protruding portion 133 is located in the positive direction of the Z-axis direction relative to the surface on a lower surface side of the substrate 137. In the substrates 137 and 138 and the bent portion 135, the ground electrode GND is arranged on the surface or in an inner layer facing the mounting substrate 20.

Further, one power feed element 121 is arranged in each of the protruding portions 133 of the substrate 138. Further, in the inner layer of the dielectric substrate of the substrate 138, a power feed element 122A is arranged so as to face each power feed element 121. Since the notch portion 136 is formed in the substrate 138, a region of the ground electrode GND coupled to each power feed element is largely limited regarding the power feed element arranged in the substrate 138.

Therefore, in the antenna module 100C, the configuration as illustrated in FIG. 6D is adopted for the power feed elements 121 and 122A arranged in the protruding portion 133. That is, the power feed element 121 is inclined with respect to the power feed element 122A such that an angle formed between the polarization direction of the power feed element 121 and a polarization direction of the power feed element 122A is greater than 0° and less than 90°. Further, regarding the power feed element 122A, the power feed element 122A is arranged to be inclined with respect to the ground electrode GND in a manner such that an angle formed by a direction connecting a position of the end portion of the ground electrode GND having a shortest distance from a center of the power feed element 122A and the center of the power feed element 122A and the polarization direction of the power feed element 122A is greater than 0° and less than 90°. At this time, in the power feed element 122A, a portion extending beyond the protruding portion 133 is cut off.

With such a configuration, even in a case where the region in which the radiating elements are arranged is limited as in the protruding portion 133 of the substrate 138, it is possible to suppress a decrease in the frequency band width.

Figure 8:
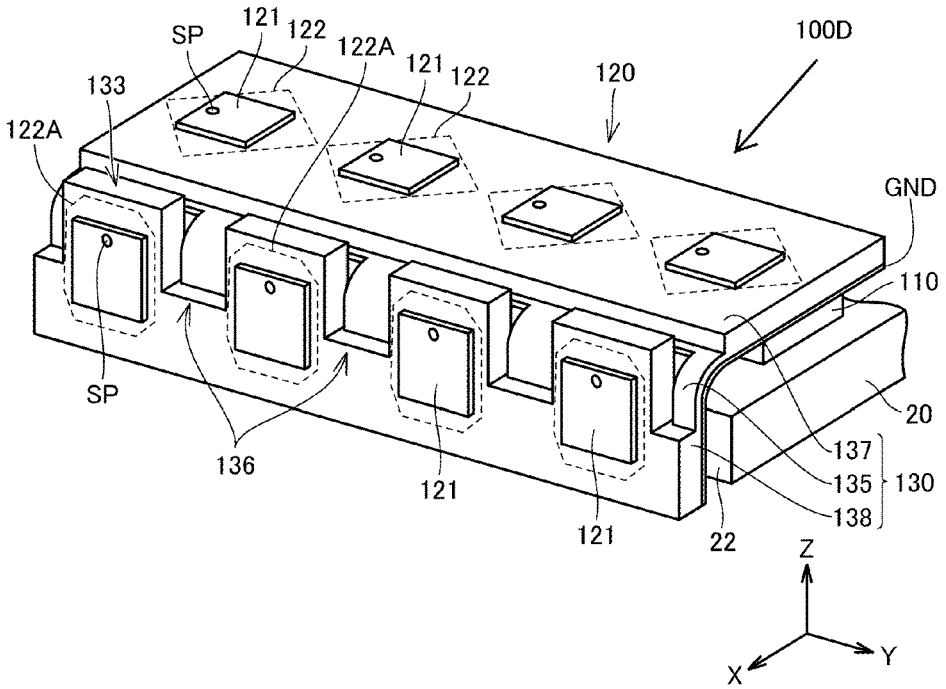
FIG. 8 is a diagram illustrating a second example of the antenna module to which Embodiment 4 is applied.

Note that, also as for the radiating elements (power feed elements 121 and 122) arranged in the substrate 137, in the case where the region in which the radiating element is to be arranged is limited as in the substrate 138, the power feed element 121 may be inclined with respect to the power feed element 122 or the power feed element 122 may be inclined with respect to the ground electrode GND, as in an antenna module 100D of FIG. 8.

Further, the notch portion 136 in the substrate 138 may not be formed in all of portions between adjacent power feed elements, and for example, there may be a portion in which two power feed elements 121 are arranged in one protruding portion.

[Embodiment 5]

In the above-described embodiment, the case where the radio wave radiated from each power feed element has one polarization direction is described.

In Embodiment 5, a description will be made of a so-called dual-polarized antenna module capable of radiating two radio waves in different polarization directions from each of the power feed element 121 and the power feed element 122.

Figure 9:
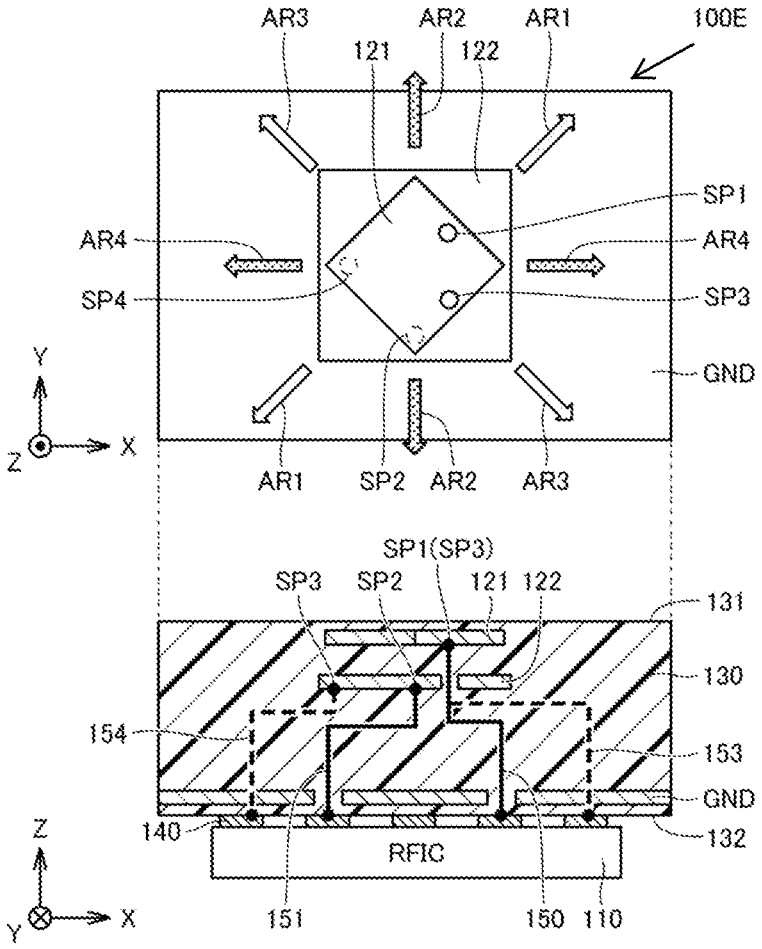
FIG. 9 is a diagram for explaining an antenna module according to Embodiment 5.

FIG. 9 is a diagram for explaining an antenna module 100E according to Embodiment 5. The antenna module 100E has a configuration in which a radio frequency signal is supplied from the RFIC 110 to a power feed point SP3 of the power feed element 121 and also a power feed point SP4 of the power feed element 122 in addition to the configuration of the antenna module 100 of Embodiment 1 illustrated in FIG. 2.

In the power feed element 121, the power feed point SP3 is arranged at a position in which the polarization in a direction (arrow AR3) orthogonal to the polarization direction (arrow AR1) of the radio wave radiated by the supply of a radio frequency signal to the power feed point SP1 can be radiated. A radio frequency signal is transmitted from the RFIC 110 to the power feed point SP3 via a power feed wiring 153.

In addition, in the power feed element 122, the power feed point SP4 is arranged at a position in which the polarization in a direction (arrow AR4) orthogonal to the polarization direction (arrow AR2) of the radio wave radiated by the supply of a radio frequency signal to the power feed point SP2 can be radiated. A radio frequency signal is transmitted from the RFIC 110 to the power feed point SP4 via a power feed wiring 154.

Also in the dual-polarized antenna module, in a case where the distance between the end portion of the power feed element 121 along the polarization direction of the power feed element 121 and the end portion of the power feed element 122 is not sufficiently secured, by arranging the power feed element 121 to be inclined with respect to the power feed element 122 so as to expand the distance between the end portion of the power feed element 121 along the polarization direction and the end portion of the power feed element 122, and thus it is possible to suppress a decrease in the frequency band width of the power feed element 121.

In addition, as in Embodiment 3, in a case where the distance between the end portion of the power feed element 122 along the polarization direction of the power feed element 122 and the end portion of the ground electrode GND is not sufficiently secured, by arranging the power feed element 122 to be inclined with respect to the ground electrode GND, it is possible to suppress a decrease in the frequency band width of the power feed element 122. Note that, in a case where the power feed element 121 extends beyond the power feed element 122 when the power feed element 121 is inclined, and/or in a case where the power feed element 122 extends beyond the ground electrode GND when the power feed element 122 is inclined, the extended portion of the power feed element may be cut off as in Embodiment 4.

Note that in the above-described embodiment, at least one of the power feed element 121 and the power feed element 122 may have a circular shape.

[Embodiment 6]

In each of the above-described embodiments, the case of the stacked dual-band antenna module is described. In Embodiment 6, a triple band type antenna module capable of radiating radio waves in three different frequency bands will be described.

Figure 10:
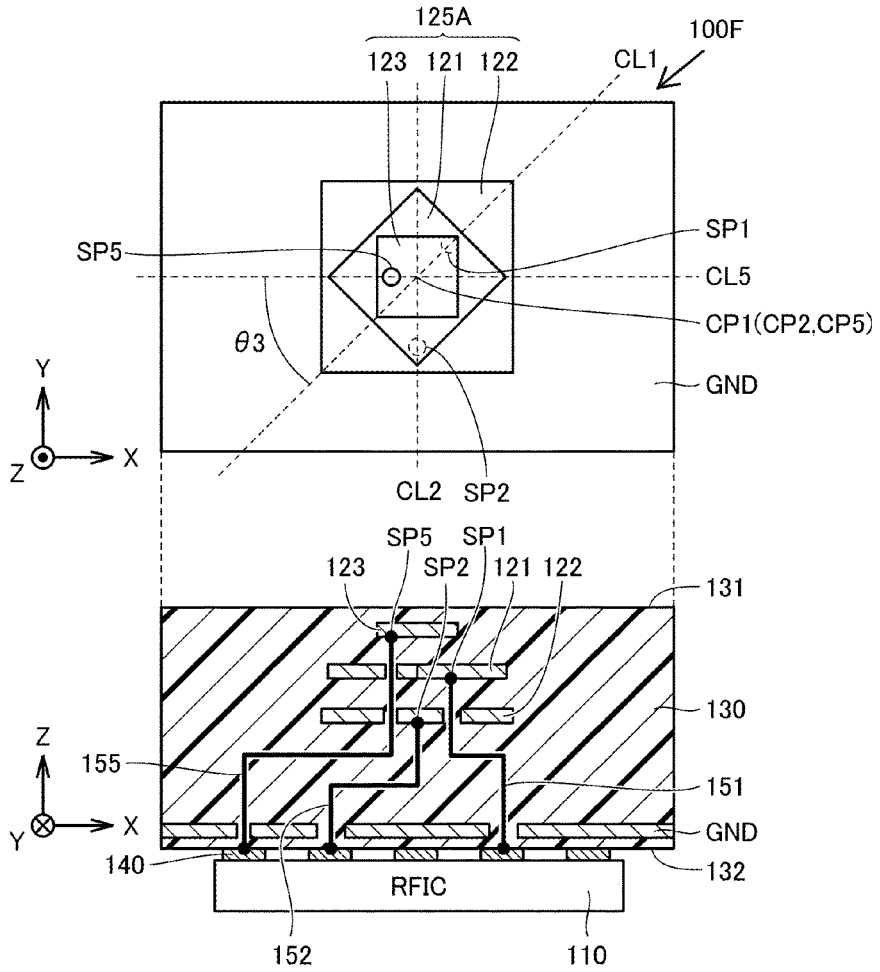
FIG. 10 is a diagram for explaining an antenna module according to Embodiment 6.

FIG. 10 is a diagram for explaining an antenna module 100F according to Embodiment 6. A plan perspective view of the antenna module 100F is illustrated in an upper stage, and a cross-sectional perspective view of the antenna module 100F is illustrated in a lower stage in FIG. 10.

Referring to FIG. 10, the antenna module 100F is configured such that the power feed elements 121 and 122 and a power feed element 123 are included as a radiating element 125A, and the power feed element 123 is further added above the power feed element 121 (in the positive direction of the Z-axis) in the antenna module 100 of Embodiment 1 illustrated in FIG. 2. Note that, in FIG. 10, description of elements which overlap with those in FIG. 2 will not be repeated.

The power feed element 123 has a substantially square shape similar to the power feed elements 121 and 122, and is arranged in a layer closer to the upper surface 131 than the power feed element 121 in the dielectric substrate 130. In other words, the power feed element 121 is arranged between the power feed element 122 and the power feed element 123. The size of the power feed element 123 is smaller than that of the power feed element 121. That is, a frequency of the radio wave radiated from the power feed element 123 is higher than the frequency of the radio waves radiated from the power feed element 121 and the power feed element 122.

A radio frequency signal is transmitted to the power feed element 123 from the RFIC 110 via a power feed wiring 155. The power feed wiring 155 passes through the ground electrode GND from the RFIC 110, passes through the power feed element 122 and the power feed element 121, and is connected to a power feed point SP5 of the power feed element 123. The power feed point SP5 of the power feed element 123 is arranged at a position offset from a center CP5 of the power feed element 123 in the negative direction of the X-axis. Therefore, when the radio frequency signal is supplied from the RFIC 110 to the power feed element 123, the radio wave having the X-axis direction as the polarization direction is radiated.

When viewed in a plan view from a normal direction of the antenna module 100F, a center CP3 of the power feed element 123 coincides with the center CP1 of the power feed element 121 and the center CP2 of the power feed element 122. The power feed element 123 is arranged so as to be rotated with respect to the power feed element 122. In other words, the power feed element 123 is arranged in a manner such that an angle formed by a direction connecting the center CP1 of the power feed element 121 and the power feed point SP1 (the direction of the line CL1) and a direction connecting the center CP5 of the power feed element 123 and the power feed point SP5 (a direction of a line CL5) is θ3. The inclination (i. e., the angle θ3) of the power feed element 123 with respect to the power feed element 121 is greater than 0° and less than 90° (0°<θ3<90°). Note that, FIG. 10 illustrates a case where θ3=45° in the antenna module 100F.

In such a configuration, a positional relationship between the power feed element 123 and the power feed element 121 is the same as a positional relationship between the power feed element 121 and the power feed element 122. That is, by arranging the power feed element 123 to be inclined with respect to the power feed element 121, it is possible to increase the frequency band width of the power feed element 123, and whereby it is possible to suppress a decrease in the antenna characteristics of the power feed element 123.

[Modification]

In the above-described embodiments, the configuration in which the radiating element and the ground electrode are formed in the same dielectric substrate is described. In a modification, a configuration in which a part or all of the radiating elements are formed in another dielectric substrate separated from the dielectric substrate in which the ground electrode is formed will be described.

(Modification 1)

Figure 11:
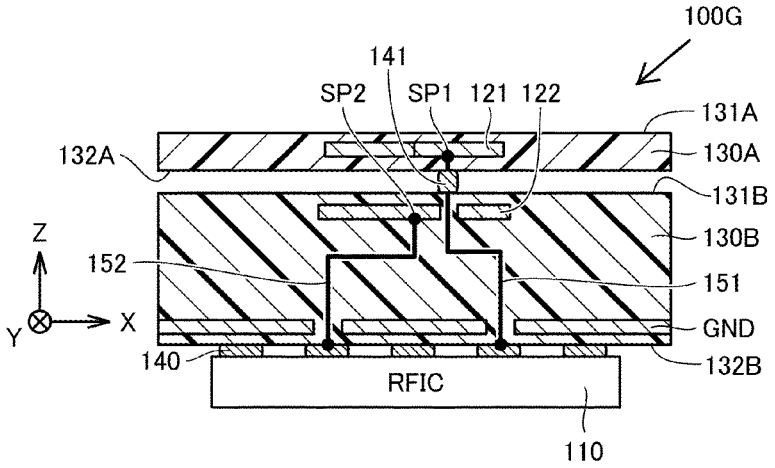
FIG. 11 is a side perspective view of an antenna module according to Modification 1.

FIG. 11 is a side perspective view of an antenna module 100G according to Modification 1. The antenna module 100G is configured such that the dielectric substrate 130 in the antenna module 100 illustrated in FIG. 2 is replaced with two dielectric substrates 130A and 130B which are separated from each other. In FIG. 11, description of elements which overlap with those in FIG. 2 will not be repeated.

Referring to FIG. 11, in the antenna module 100G, the power feed element 121 is formed in an upper surface 131A or an inner layer of the dielectric substrate 130A. On the other hand, the power feed element 122 and the ground electrode GND are formed in the dielectric substrate 130B separated from the dielectric substrate 130A. On a lower surface 132B of the dielectric substrate 130B, the RFIC 110 is mounted via the solder bump 140.

A lower surface 132A of the dielectric substrate 130A and an upper surface 131B of the dielectric substrate 130B are connected to each other by a connection member. In the example of FIG. 11, a case where a solder bump 141 is used as the connection member is illustrated, but the connection member may be a cable or a connector having flexibility. The power feed wiring 151 electrically connects the RFIC 110 and the power feed element 121 via the solder bumps 141.

Also in such a configuration, by arranging the polarization direction of the power feed element 121 to be inclined with respect to the polarization direction of the power feed element 122, it is possible to expand the frequency band width, and thus it is possible to suppress a decrease in the antenna characteristics of the power feed element 121 on the high-frequency side.

(Modification 2)

Figure 12:
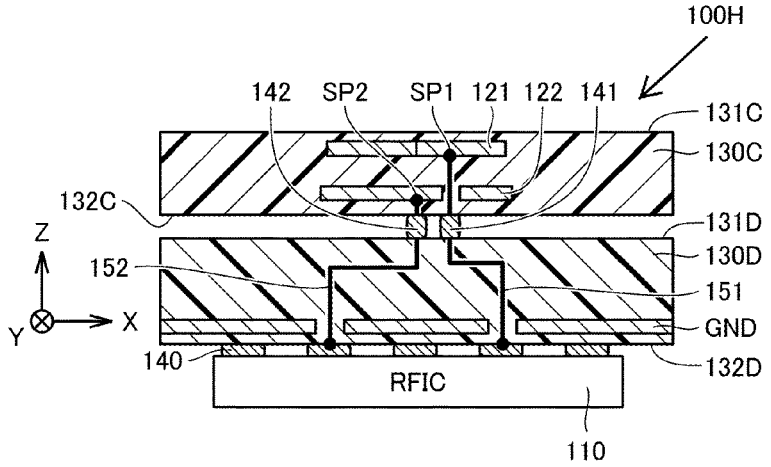
FIG. 12 is a side perspective view of an antenna module according to Modification 2.

FIG. 12 is a side perspective view of an antenna module 100H according to Modification 2. The antenna module 100H is configured such that the dielectric substrate 130 in the antenna module 100 illustrated in FIG. 2 is replaced with two dielectric substrates 130C and 130D which are separated from each other. In FIG. 12, description of elements which overlap with those in FIG. 2 will not be repeated.

Referring to FIG. 12, in the antenna module 100H, the power feed element 121 and the power feed element 122 are formed in the dielectric substrate 130C. The power feed element 121 is formed in an upper surface 131C or an inner layer of the dielectric substrate 130C. The power feed element 122 is formed in a layer between the power feed element 121 and a lower surface 132C in the dielectric substrate 130C. On the other hand, the ground electrode GND is formed in the dielectric substrate 130D separated from the dielectric substrate 130C. On a lower surface 132D of the dielectric substrate 130D, the RFIC 110 is mounted via the solder bump 140.

The lower surface 132C of the dielectric substrate 130C and an upper surface 131D of the dielectric substrate 130D are connected to each other by a connection member. In the example of FIG. 12, a case where the solder bump 141 and a solder bump 142 are used as the connection member is illustrated, but the connection member may be a cable or a connector having flexibility.

The power feed wiring 151 electrically connects the RFIC 110 and the power feed element 121 via the solder bumps 141. Similarly, the power feed wiring 152 electrically connects the RFIC 110 and the power feed element 122 via the solder bumps 142.

Also even in such a configuration, by arranging the polarization direction of the power feed element 121 to be inclined with respect to the polarization direction of the power feed element 122, the frequency band width can be expanded, and thus it is possible to suppress a decrease in the antenna characteristics of the power feed element 121 on the high-frequency side.

Note that, in the antenna module having three power feed elements as a radiating element, as described in Embodiment 6, a part or all of the power feed elements may be formed in a dielectric substrate different from the dielectric substrate in which the ground electrode is formed. In addition, three power feed elements may be formed in three different dielectric substrates, respectively.

It should be considered that the embodiments disclosed herein are illustrative in all respects and are not restrictive. The scope of the present disclosure is indicated by the claims rather than the description of the above-described embodiments, and it is intended to include all modifications within the meaning and scope equivalent to the scope of the claims.

REFERENCE SIGNS LIST

10 COMMUNICATION DEVICE
20 MOUNTING SUBSTRATE
22 SIDE SURFACE
100, 100A to 100H, 100X ANTENNA MODULE
110 RFIC
111A to 111H, 113A to 113H, 117A, 117B SWITCH
112AR to 112HR LOW NOISE AMPLIFIER
112AT to 112HT POWER AMPLIFIER
114A to 114H ATTENUATOR
115A to 115H PHASE SHIFTER
116A, 116B SIGNAL MULTIPLEXER/DEMULTIPLEXER
118A, 118B MIXER
119A, 119B AMPLIFIER CIRCUIT
120 ANTENNA DEVICE
121,122, 122A, 123 POWER FEED ELEMENT
125, 125A RADIATING ELEMENT
130 DIELECTRIC SUBSTRATE

131, 131A to 131D UPPER SURFACE
132, 132A to 132D LOWER SURFACE
133 PROTRUDING PORTION
135 BENT PORTION
136 NOTCH PORTION
137, 138 SUBSTRATE
140 to 142 SOLDER BUMP
151 to 155 POWER FEED WIRING
200 BBIC
GND GROUND ELECTRODE
SP1 to SP5 POWER FEED POINT

The invention claimed is:

1. An antenna module comprising:

a first power feed conductor having a flat plate shape that is configured to radiate a first radio wave having a first polarization direction;

a first ground electrode arranged so as to face the first power feed conductor; and a second power feed conductor having a flat plate shape that is arranged between the first power feed conductor and the first ground electrode, and that is configured to radiate a second radio wave having a second polarization direction, wherein:

when the antenna module is viewed in a plan view from a normal direction of the first power feed conductor, the first power feed conductor and the second power feed conductor overlap each other, a frequency of the first radio wave radiated from the first power feed conductor is higher than a frequency of the second radio wave radiated from the second power feed conductor, a first angle formed by the first polarization direction and the second polarization direction is greater than 0° and less than 90°, a shortest distance between the center of the first power feed conductor and the end portion of the second power feed conductor is a second distance, and as viewed in the plan view:

a distance between the end portion of the second power feed conductor along a direction of the second distance and an end portion of the first power feed conductor is a third distance, and the third distance is shorter than ½ of a size of the first power feed conductor, and is greater than zero.

2. The antenna module according to claim 1, wherein as viewed in the plan view:

a shortest distance along the first polarization direction between a center of the first power feed conductor and an end portion of the second power feed conductor is a first distance, the first distance is longer than the second distance.

3. The antenna module according to claim 1, wherein a shape of the second power feed conductor is a polygon having at least four vertices.

4. The antenna module according to claim 1, wherein a second angle formed by a direction connecting an end portion of the first ground electrode having a shortest distance from a center of the second power feed conductor and a center of the second power feed conductor, and the second polarization direction, is greater than 0° and less than 90°.

5. The antenna module according to claim 4, wherein as viewed in the plan view:

a shortest distance along the second polarization direction between the center of the second power feed conductor and the end portion of the first ground electrode is a fourth distance, a shortest distance between the center of the second power feed conductor and the end portion of the first ground electrode is a fifth distance, a distance between the end portion of the first ground electrode and an end portion of the second power feed conductor along a direction of the fifth distance is a sixth distance, and the fourth distance is longer than the fifth distance, and the sixth distance is shorter than ½ of a size of the second power feed conductor.

6. The antenna module according to claim 1, wherein the first power feed conductor is further configured to radiate a third radio wave having a third polarization direction that is orthogonal to the first polarization direction.

7. The antenna module according to claim 1, wherein the second power feed conductor is further configured to radiate a third radio wave having a third polarization direction that is orthogonal to the second polarization direction.

8. The antenna module according to claim 1, further comprising a third power feed conductor having a flat plate shape; and a second ground electrode arranged so as to face the third power feed conductor, wherein a normal direction of the third power feed conductor is different than the normal direction of the first power feed conductor and the second power feed conductor.

9. The antenna module according to claim 8, further comprising a fourth power feed conductor arranged between the third power feed conductor and the second ground electrode, wherein:

the third power feed conductor is configured to radiate a third radio wave having a third polarization direction, the fourth power feed conductor is configured to radiate a fourth radio wave having a fourth polarization direction, when the antenna module is viewed in a plan view from a normal direction of the third power feed conductor, the third power feed conductor and the fourth power feed conductor overlap each other, a frequency of the third radio wave radiated from the third power feed conductor is higher than a frequency of the fourth radio wave radiated from the fourth power feed conductor, and a third angle formed by the third polarization direction and the fourth polarization direction is greater than 0° and less than 90°.

10. The antenna module according to claim 9, wherein a fourth angle formed by a direction connecting an end portion of the second ground electrode having a shortest distance from a center of the fourth power feed conductor and a center of the fourth power feed conductor, and the fourth polarization direction, is greater than 0° and less than 90°.

11. The antenna module according to claim 1, further comprising a fifth power feed conductor and a sixth power feed conductor each having a flat plate shape and arranged so as to face the first ground electrode, wherein:

the fifth power feed conductor is configured to radiate a fifth radio wave having the first polarization direction, the sixth power feed conductor is arranged between the fifth power feed conductor and the first ground electrode, and is configured to radiate a sixth radio wave having the second polarization direction, when the antenna module is viewed in a plan view from a normal direction of the fifth power feed conductor, the fifth power feed conductor and the sixth power feed conductor overlap each other, and a frequency of the fifth radio wave radiated from the fifth power feed conductor is higher than a frequency of the sixth radio wave radiated from the sixth power feed conductor.

12. The antenna module according to claim 1, further comprising a power feed circuit configured to supply a radio frequency signal to each power feed conductor.

13. A communication device comprising the antenna module according to claim 1.

* * * * *